US006032993A

United States Patent [19]

Kwon

[11] Patent Number: 6,032,993

[45] Date of Patent: Mar. 7, 2000

[54] EASILY DISCONNECTABLE HOIST RING ASSEMBLY

[76] Inventor: Soon Chil Kwon, Olympic Sunsu Kijachon Apt., 310 Dong 509 HO, Song-Pa-Gu, Bang-1-Dong #89, Seoul, Rep. of Korea

[21] Appl. No.: 09/108,990

[22] Filed: Jul. 1, 1998

[51] Int. Cl.[7] ..... B66C 1/66

[52] U.S. Cl. ..... 294/1.1; 294/89; 403/78; 403/164

[58] Field of Search ..... 294/1.1, 82.1, 294/89; 403/78, 79, 119, 164, 165; 52/125.2, 125.5, 125.6, 698, 704; 248/499; 410/101

[56] References Cited

U.S. PATENT DOCUMENTS

| | | | |
|---|---|---|---|
| 4,570,987 | 2/1986 | Wong et al. | 294/1.1 |
| 4,592,686 | 6/1986 | Andrews | 294/1.1 |
| 4,705,422 | 11/1987 | Tsui et al. | 294/1.1 |
| 5,248,176 | 9/1993 | Fredriksson | 294/1.1 |
| 5,352,056 | 10/1994 | Chandler | 294/82.1 |
| 5,634,734 | 6/1997 | Schron, Jr. et al. | 294/1.1 |
| 5,823,588 | 10/1998 | Morghen | 294/1.1 |

*Primary Examiner*—Dean J. Kramer
*Attorney, Agent, or Firm*—Dillis V. Allen, Esq.

[57] ABSTRACT

A hoist ring assembly for transporting loads, including an anchor bushing that is threaded into the load and forms the pivot for a releasable swivel hanger assembly with a shackle connectable to an overhead hoist. The swivel hanger is easily attachable to and detachable from the anchor bushing to expedite load movement. The hanger swivels on the anchor bushing in a side-pull or center pull action and has diametral retractable locking pins that enter the anchor bushing in the attached mode that when retracted permit the hanger to be rapidly removed from the anchor bushing.

13 Claims, 4 Drawing Sheets

EASILY DISCONNECTABLE HOIST RING ASSEMBLY

RELATED APPLICATION

This application is related to the application entitled QUICK CHANGE SIDE PULL HOIST RING ASSEMBLY of Yong Chin Kwon, U.S. Ser. No. 09/072,823, Filed: May 5, 1998, assigned to the inventor of this application, Soon Chil Kwon.

BACKGROUND OF THE INVENTION

EASILY DISCONNECTABLE HOIST RING ASSEMBLY

Swivel shackle assemblies have been used for many years in conjunction with cables and a hoist to lift and move heavy objects about the workplace, such as dies, molds, heavy castings, etc. These swivel shackle assemblies typically include a "U" shaped shackle member that is pivotal on a swivel body that in turn is rotatable about an axis on a base that is perpendicular to the swivel axis of the shackle on the base. This enables the shackle to accommodate two axes pivotal movement which is necessary for the geometry of the hoist arrangement.

In a typical hoist arrangement, an overhead crane has a depending single cable that is tied to four(more or less) outwardly extending cables connected to the shackle assemblies. Each shackle assembly typically has a threaded fastener extending centrally there-through that bolts the shackle directly to the top surface of the die or mold.

The following patents are representative of the prior art relating to dual axis hoist shackle assemblies.

The Andrewe, et al., U.S. Pat. No. 3,297,293, issued Jan. 10, 1967; the Tsui, et al., U.S. Pat. No. 4,705,422, issued Nov. 10, 1987; and the Chandler, U.S. Pat. No. 5,352,056, issued Oct. 4, 1994, all show swivel shackle assemblies having a "U" shaped member or shackle that is pinned to a rotary swivel member by transverse pins that are separate from the "U" member itself. In this design, it is necessary to fix these shackle pins in the swivel body.

A second group of patents represented by the Wong, et al., U.S. Pat. No. 4,570,987, issued Feb. 18, 1996; the Tsui, et al., U.S. Pat. No. 4,641,986, issued Feb. 10, 1987; and the Tsui, U.S. Pat. No. 5,405,210, issued Apr. 11, 1995, show hoist swivel shackle assemblies in which the ends of the "U" shaped shackle extend radially inwardly and form the pivotal bosses for the shackle on the swivel body member. This design somewhat reduces the long term loading problem on the shackle discussed above, but it does not significantly minimize that problem.

The Mueller, U.S. Pat. No. 3,492,033, discloses a clevis assembly with a locking ring 48 for locking the stud to the load. Mueller's clevis is not easily disassembled, however.

The Brawand, U.S. Pat. No. 3,163,901, shows a cargo hook and chain device in which a line holder 14 is detachable from member 10 and adapted to hold one or more load cables 16. The line holder 14 has an arcuate slot that permits its removal from a swivel-type draft line terminal member 10. There is no significant savings in the Brawand device because the line holding member 14 is a simple inexpensive loop-shape member.

The Blatt, U.S. Pat. No. 3,628,820, shows a side pull type swivel-type hoist ring assembly in which the hoist ring is generally perpendicular to the axis of the shoulder screw 28. Blatt's retaining ring 22 and block 12 are not readily removable from the screw 28.

The Bateman, U.S. Pat. No. 1,321,356, shows an anchor shank and shackle in which the shackle itself is removable from the anchor shank 9. However, the anchor shank 9 is not a swivel-type anchor shank and the removal of the shackle by itself results in no significant savings or benefits.

The Jergens Manufacturing Co. makes a line of side pull style hoist rings identified as part numbers 47311 to 47319 that have extra-large diameter rings and generally U-shaped swivel members. The swivel members, however, cannot be removed from the load without removing the anchor bushing itself.

In U.S. Ser. No. 09/072,823, a side pull hoist ring assembly is described for transporting loads including an anchor bushing that is threaded into the load and forms the pivot for a releasable hanger ring assembly with a shackle connectable to an overhead hoist. The hanger ring is quickly attachable and detachable from the anchor bushing to expedite load movement. The hanger ring swivels on the anchor bushing in a side pull action and has a key hole slot that hangs the anchor bushing during use and permits the hanger ring to be rapidly removed from the anchor bushing when the hoist is slacked by shifting a latch lever out of the way and lowering the swivel hanger to the large portion of the key hole slot that enables removal of the swivel hanger. The latch lever holds the hanger ring on the anchor bushing when the swivel hanger ring is unloaded.

It is a primary object of the present invention to ameliorate the problems noted above and provide side pull and center pull hoist ring assemblies with an easily removable swivel and shackle.

SUMMARY OF THE PRESENT INVENTION

In accordance with the present invention, side pull and center pull hoist ring assemblies are provided for transporting loads each including an anchor bushing that is threaded into the load and forms the pivot for a releasable hanger assembly with a shackle connectable to an overhead hoist. The hanger ring is easily attachable and detachable from the anchor bushing to expedite load movement. The hanger ring swivels on the anchor bushing in either a side pull action or a center pull action and has a pair of diametrally opposed retractable pins that enter the anchor bushing to lock the hanger ring on the bushing and when retracted permit the hanger ring to be rapidly removed from the anchor bushing.

Because the shackle and swivel hanger ring assembly are readily removable from the anchor bushing, new methods of use become feasible. For example, when moving multiple loads from position A to position B, worker number 1 begins attaching four anchor bushings to each of the loads. While he is doing this, worker number 2 installs four swivel hanger ring and shackle assemblies to the first load finished by worker number 1, connects the shackle to the hoist and moves the first load to position B. He then quickly releases the four swivel hanger rings and returns them with the hoist to position A where he attaches the same four swivel hanger rings to the previously installed anchor bushings on the second load and repeats the hoisting.

The benefits of this process, which result directly from the design of the present hoist ring assembly, are firstly a much faster load transfer because the anchor bushing installation time does not reduce multiple load total travel time. Plus, the user needs fewer swivel hanger rings and shackle assemblies and can purchase many more anchor bushings than swivel hanger rings at a substantial cost saving because the anchor bushings are substantially less costly than the swivel hanger ring and shackle assemblies.

Other objects and advantages of the present invention will appear more clearly from the following detailed description.

DETAILED DESCRIPTION OF THE PREFERRED EMBODIMENTS

Figure 15:
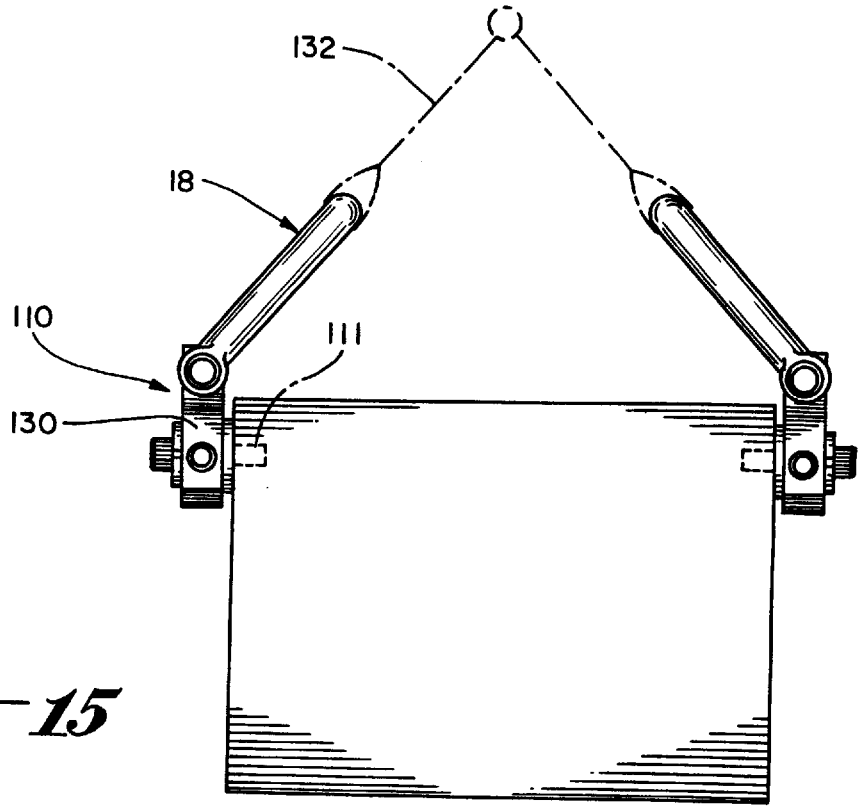
FIG. 15 is an illustration of two hoist ring assemblies attached to a load and an overhead conveyor system shown diagrammatically.

Referring to the drawings and particularly the embodiment shown in FIGS. 1 to 7, a center pull hoist ring assembly 10 is illustrated, and this design is particularly suitable for mounting on the top surface of a load illustrated at 12 in the drawings. Typically, the load is provided with a plurality of threaded bores 13 that are symmetrically arranged on the top surface of the load in either a two hole or four hole pattern and each receives one of the center pull hoist ring assemblies 10. This design is in distinction to the side pull hoist ring assemblies 110 illustrated in FIGS. 8 to 15, and as shown in FIG. 15, the side pull hoist ring assemblies are mounted symmetrically in either a two or four pattern on the sides of the load to be conveyed.

Returning to the center pull hoist ring assembly 10, it is seen to generally include an anchor bushing assembly 14, a hanger ring assembly 16, and a shackle assembly 18. As seen clearly in FIGS. 1 and 3, for example, the anchor bushing assembly 14 includes a threaded stud 20 that extends through an upper bushing 21 and a lower bushing 22 through a washer 23 into threaded bore 13. The upper bushing 21 has a flange seated in a counter bore 27 in the top of bushing sleeve 28, while lower bushing 22 has a flange 29 seated on the bottom surface of sleeve 28. The bushings 21 and 22 are sized in axial extent so that they engage one another as the threaded stud 20 is torqued to its maximum torque position and absorb the clamping load to permit the sleeve 28 to rotate freely on the bushings and provide the desired swiveling movement for the ring assembly 16 on the anchor bushing 14.

Figure 1:
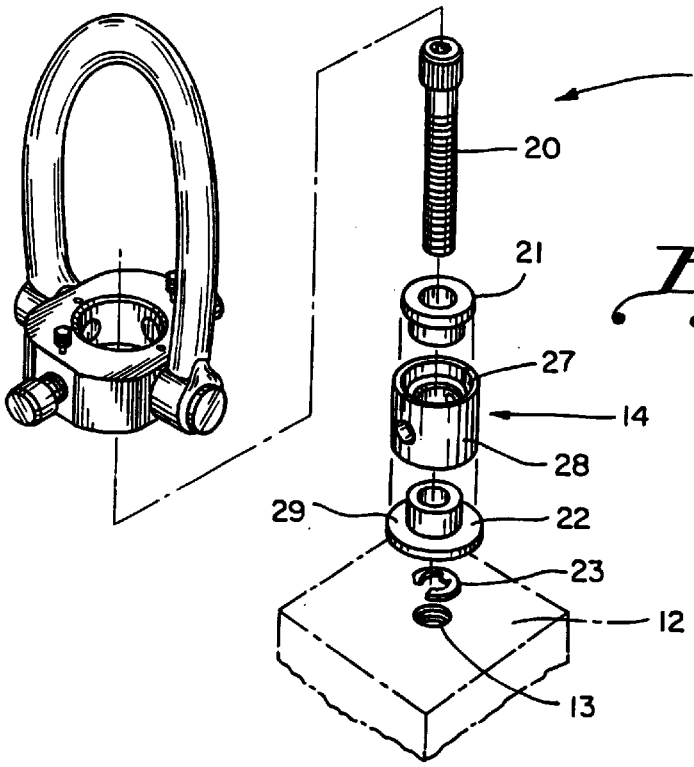
FIG. 1 is an exploded view of a center pull hoist ring assembly according to one embodiment of the present invention.
Figure 3:
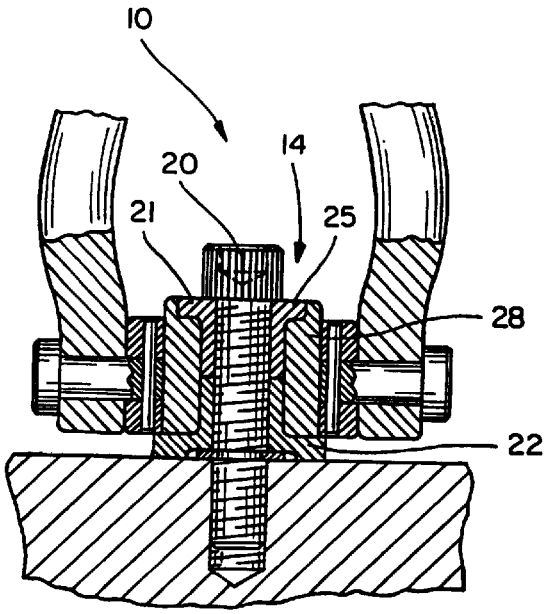
FIG. 3 is an enlarged partly fragmented side view of the hoist ring assembly illustrated in FIGS. 1 and 2, assembled.
Figure 2:
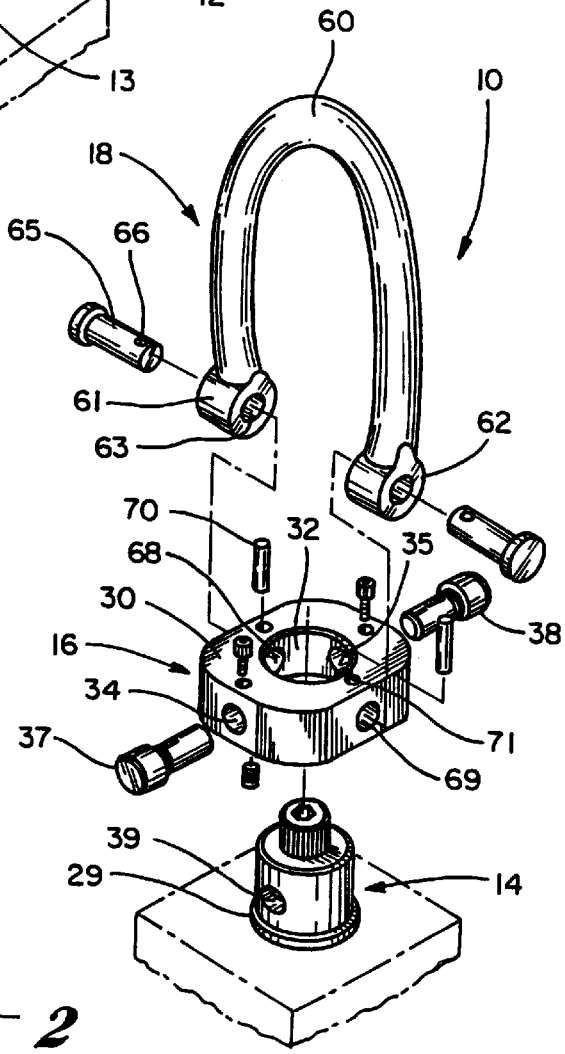
FIG. 2 is a partly exploded perspective view of the hoist ring assembly illustrated in FIG. 1 with the anchor bushing assembled.

The hanger ring assembly 16 includes a body 30 that has a generally toroidal configuration with a large central through bore 32 that slides over and engages the outer surface of the anchor bushing sleeve 28. As seen in FIGS. 2 and 3, the lower bushing flange 29 engages the lower surface of the body 30 and provides a stop for the hanger ring assembly 16.

Figure 4:
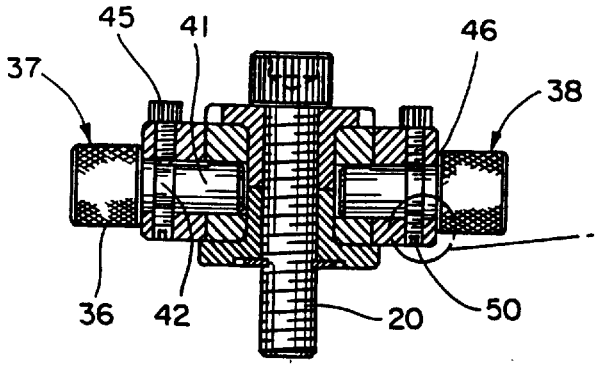
FIG. 4 is a vertical cross section of the hanger ring and anchor bushing.
Figure 4A:
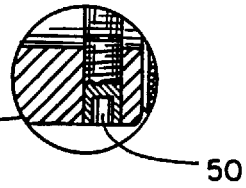
FIG. 4*a* is a fragmented enlargement of the lower locking screw in FIG. 4.
Figure 5:
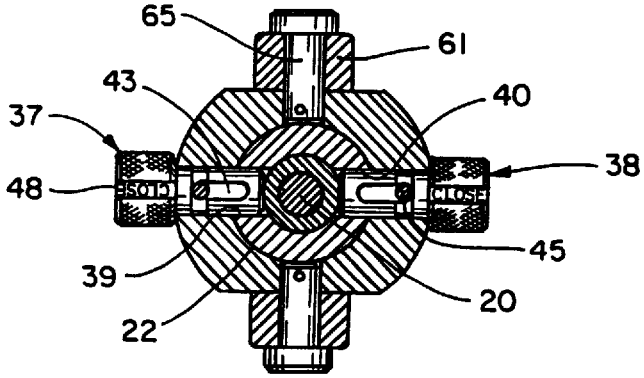
FIG. 5 is a top view cross section of the anchor bushing and hanger ring.
Figure 6:
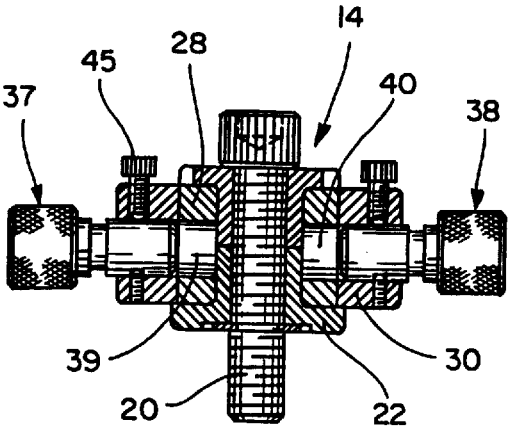
FIG. 6 is a cross section of the hanger ring and anchor bushing assembly similar to FIG. 4 except with the locking pins retracted.
Figure 7:
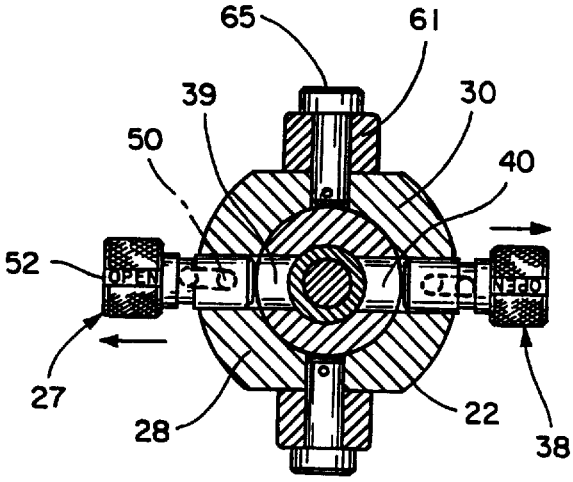
FIG. 7 is a top view cross section similar to FIG. 5 with the locking pins retracted.
Figure 8:
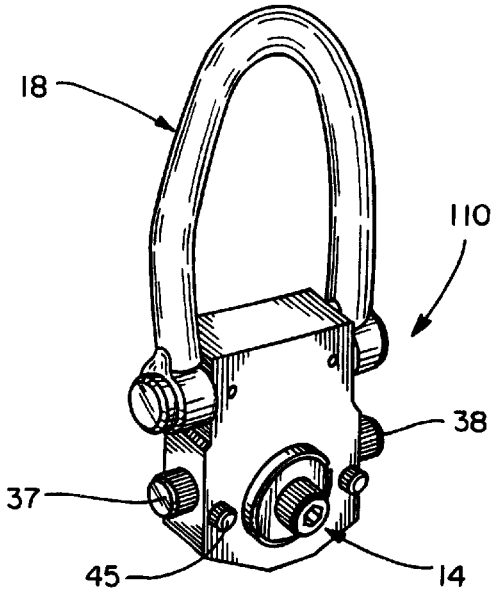
FIG. 8 is a perspective view of a side pull hoist ring assembly according to a second embodiment of the present invention.
Figure 9:
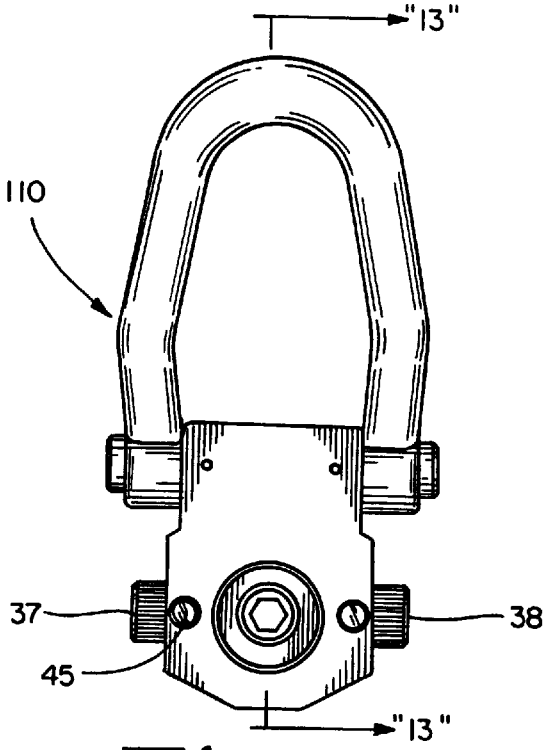
FIG. 9 is an enlarged front view of the hoist ring assembly illustrated in FIG. 8.
Figure 10:
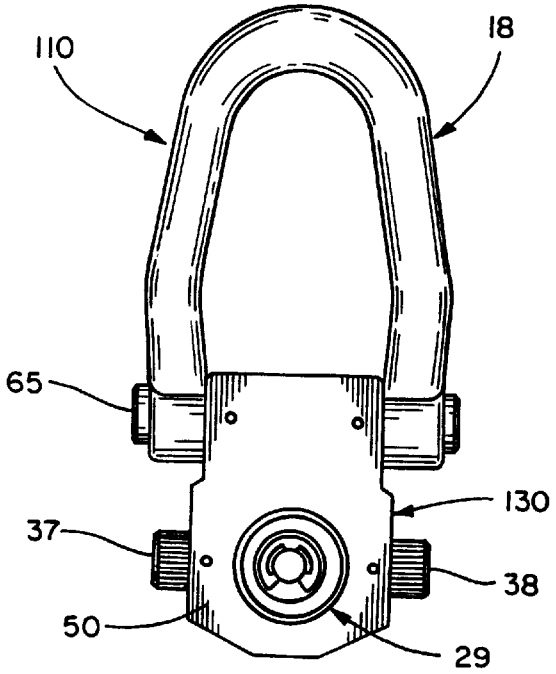
FIG. 10 is a rear view of the hoist ring assembly illustrated in FIG. 9.
Figure 11:
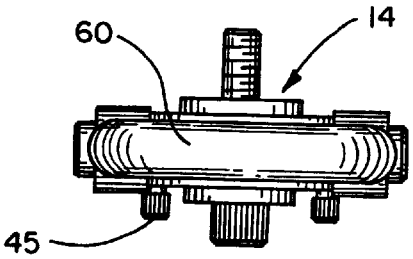
FIG. 11 is a top view of the hoist ring assembly illustrated in FIGS. 8, 9 and 10.
Figure 12:
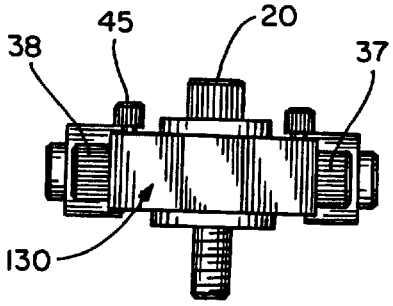
FIG. 12 is a bottom view of the hoist ring assembly illustrated in FIGS. 8 to 11.
Figure 13:
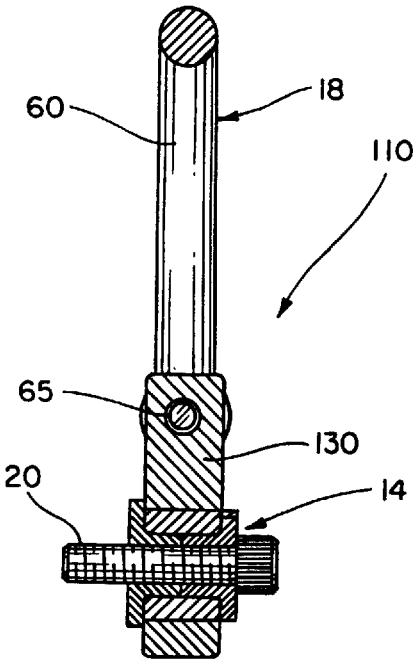
FIG. 13 is a longitudinal section of the hoist ring assembly taken generally along line 13—13 of FIG. 9.
Figure 14:
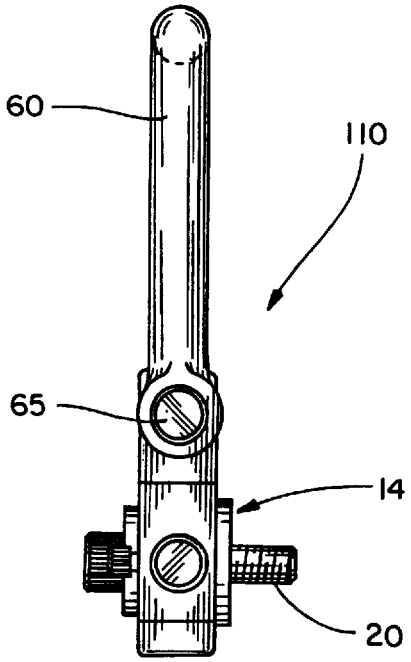
FIG. 14 is a side view of the hoist ring assembly illustrated in FIGS. 8 to 13.

The body 30 has a pair of aligned bores 34 and 35 therethrough that receive a pair of identical retractable pins 37 and 38 that lock the body 30 to the anchor bushing through diametrally aligned bores 39 and 40(FIGS. 2 and 5) in the anchor bushing sleeve 28. The pins 37 and 38 have enlarged knurled heads 40, a shank portion 41 slidable in the bores 34, 35, a reduced land portion 42, and an axial slot 43 extending inwardly from the reduced land portion 42. A pair of upper thumb screws 45 have tips 46 that engage the reduced land 42 and hold the locking pins 37 and 38 in their inner locking position shown in FIG. 5, with the pins extending into bores 39 and 40. Note that the locking pins have the legend "close" 48 on their outer surfaces that face upwardly when the pins are in their locking position. A pair of lower set screws 50(FIGS. 4 and 4*a*) that are threaded into the lower surface of the body 30 and enter the bores 34 and 35 in the same vertical plane as the thumb screws 45, ride in the reduced land 42 but are adjusted so that they do not engage the land 42, and thus do not prevent rotation of the pins 37 and 38. Rotation of the pins 37 and 38 is prevented by the tips 46 of the thumb screws 45 engaging the land.

When it is desired to remove the hanger ring assembly 16, as well as the shackle 18 from the load, the thumb screws 45 are retracted beyond the diameter of the pin shanks 41 permitting the operator to rotate the pins 180 degrees. An "open" legend 52 is positioned 180 degrees from the legend 48 on the heads 40 so the operator knows that when the "open" legend 52 is facing up in a vertical plane, the pins are in their correct angular orientation for withdrawal. In this position, the slots 43 face vertically downwardly in alignment with the screws 50 permitting the pins to be retracted as the screws ride in the axial slots 43. Complete removal of the pins 37, 38 is prevented by engagement of the screws 50 with the inner ends of the slots 43.

The hanger ring assembly can then be removed by pulling on the shackle assembly 18, sliding the hanger ring assembly vertically upwardly away from the anchor bushing. Reattachment is achieved by simply lowering the hanger ring assembly over the anchor bushing, with the pins in the "open" position illustrated in FIG. 7, then pushing the pins inwardly until they engage the outer surfaces of the bushings 21 and 22, which defines the correct inner axial position of the pins, and then rotating the pins 180 degrees so that the "close" legend 48 faces upwardly. Then thumb screws 45 are threaded inwardly until their tips engage the bottom of the lands 42 preventing pin rotation.

The shackle assembly 18 includes a generally "U" shaped shackle 60 having end bosses 61 and 62 with bores 63 therethrough that receive Clevis pins 65 having cross holes 66 near their ends. Pins 65 extend through the bosses 63 into bores 68 and 69 in body 30. Roll pins 70 are driven into cross bores 71 and through pin holes 66 locking the Clevis pins 65 in position and providing the correct pivotal bearing bosses for the shackle 60 on the hanger ring body 30.

The second embodiment illustrated in FIGS. 8 to 15 is, as noted above, a side pull hoist ring 110 designed to be attached into threaded bores 111(FIG. 15) in the sides of the intended load. This embodiment is generally similar to the one illustrated in FIGS. 1 to 7 and like parts have been identified with the same reference numerals. For example, the anchor bushing assembly 14, the locking pins 37 and 38, shackle assembly 18, and the set screws 50 are all identical to the same parts in the FIGS. 1 to 7 embodiment. The only part that is materially different is the hanger ring body 130 that is elongated compared to the body 30 in the FIGS. 1 to 7 embodiment to accommodate the need for axial bores in the body for receiving shackle assembly pins 65 without interfering with the locking pins 37 and 38. In a center pull hoist ring, the shackle is generally perpendicular to the hanger ring body, while in the side pull embodiment, the hanger assembly is generally coplanar with the body 130 of the hanger ring assembly, although as seen in FIG. 15, the shackle assemblies 18 are pivotal out of the plane of the body 130 in alignment with the hoist cables 132 shown only diagrammatically in FIG. 15.

The method of detachment and reattachment of the body 130 from the anchor bushing assembly 14 in the FIGS. 8 to 14 embodiment is identical to that described above with respect to the center pull hoist ring assembly 10.

I claim:

1. A hoist ring assembly, comprising: an anchor bushing having a threaded stud connectable to a load, a hanger ring releasably connected to the anchor bushing, a shackle pivotally mounted on the hanger ring, and means to releasably connect the hanger ring to the anchor bushing without removing the threaded stud from the load and without disassembling the shackle from the hanger ring including retractable unthreaded quick release pin means carried by the hanger ring and insertable into the anchor bushing, said quick release pin means being movable from a first position locking the hanger ring to the anchor bushing and being movable by hand without tools to a second position releasing the hanger ring from the anchor bushing, said quick release pin means being attached to the hanger ring in both the first position and the second position.

2. A hoist ring assembly, comprising: an anchor bushing connectable to a load, a hanger ring releasably connected to the anchor bushing, a shackle pivotally mounted on the hanger ring, and means to releasably connect the hanger ring to the anchor bushing including retractable pin means carried by the hanger ring and insertable into the anchor bushing, said anchor bushing including a cylindrical outer surface, said hanger ring having a cylindrical inner surface that engages and is slidable axially on the anchor bushing cylindrical outer surface, said anchor bushing cylindrical outer surface having at least one aperture therein for releasably receiving the pin means carried by the hanger ring.

3. A hoist ring assembly, comprising: an anchor bushing connectable to a load, a hanger ring releasably connected to the anchor bushing, a shackle pivotally mounted on the hanger ring, and means to releasably connect the hanger ring to the anchor bushing including retractable pin means carried by the hanger ring and insertable into the anchor bushing, said pin means including a pin having a manual operator projecting outwardly from the hanger ring, said manual operator being rotatable from a first position locking the pin in the anchor bushing to a second position permitting the pin to be withdrawn from the anchor bushing enabling the hanger ring to be removed from the anchor bushing.

4. A hoist ring assembly as defined in claim 3, wherein the pin means pin has an axial slot that connects with an annular groove in the pin, a radial member in the hanger ring projecting into the annular groove in the first position of the operator to block movement of the pin from the anchor bushing and movable into the axial slot in the second position of the operator to permit withdrawal of the pin from the anchor bushing, said slot also limiting outward movement of the pin from the hanger ring.

5. A hoist ring assembly, comprising: an anchor bushing connectable to a load, a hanger ring releasably connected to the anchor bushing, a shackle pivotally mounted on the hanger ring, and means to releasably connect the hanger ring to the anchor bushing including retractable pin means carried by the hanger ring and insertable into the anchor bushing, said anchor bushing including a rotatable outer sleeve so the hanger ring can swivel on the anchor bushing.

6. A hoist ring assembly, comprising: an anchor bushing connectable to a load, a hanger ring releasably connected to the anchor bushing, a shackle pivotally mounted on the hanger ring, and means to releasably connect the hanger ring to the anchor bushing including retractable pin means carried by the hanger ring and insertable into the anchor bushing, said anchor bushing includes a rotatable outer sleeve so that hanger ring can swivel on the anchor bushing, said sleeve having a pair of axially aligned bores therein, said pin means including axially aligned pins engageable in the sleeve bores.

7. A hoist ring assembly, comprising: an anchor bushing having a threaded stud connectable to a load, a hanger ring releasably connected to the hoist ring assembly, a shackle pivotally mounted on the hanger ring, and means to releasably connect the hanger ring to the anchor bushing without removing the threaded stud from the load and without disassembling the shackle from the hanger ring including quick release retractable pin means carried by the hanger ring and insertable into the anchor bushing, said anchor bushing including a cylindrical outer surface, said hanger ring having a cylindrical inner surface that engages and is slidable axially on the anchor bushing cylindrical outer surface, said anchor bushing cylindrical outer surface having at least one aperture therein for releasably receiving the pin means carried by the hanger ring.

8. A hoist ring assembly as defined in claim 7, said anchor bushing including a rotatable outer sleeve so the hanger ring can swivel in the anchor bushing.

9. A hoist ring assembly, comprising: an anchor bushing connectable to a load, a hanger ring releasably connected to the anchor bushing, a shackle pivotally mounted on the hanger ring, and means to releasably connect the hanger ring to the anchor bushing including retractable pin means carried by the hanger ring and insertable into the anchor bushing, said anchor bushing including a rotatable outer sleeve so the hanger ring can swivel in the anchor bushing, said sleeve having a pair of axially aligned bores therein, said pin means including axially aligned pins engageable in the sleeve bores.

10. A hoist ring assembly, comprising: an anchor bushing having a threaded stud connectable to a load, a hanger member releasably connected to the anchor bushing, a shackle pivotally mounted on the hanger member, and means to releasably connect the hanger member to the anchor bushing without removing the threaded stud from the load and without disassembling the shackle from the hanger member including an unthreaded quick release retractable member carried by the hanger member and insertable into the anchor bushing, said quick release retractable member being movable from a first position locking the hanger member to the anchor bushing and being movable by hand without tools to a second position releasinq the hanger member from the anchor bushing, said quick release retractable member being attached to the hanger member in both the first and the second position.

11. A hoist ring assembly, comprising: an anchor bushing connectable to a load, a hanger member releasably connected to the anchor bushing, a shackle pivotally mounted on the hanger member, and means to releasably connect the hanger member to the anchor bushing including a retractable member carried by the hanger member and insertable into the anchor bushing, said retractable member including two opposed pins.

12. A hoist ring assembly, comprising: an anchor bushing connectable to a load, a hanger ring releasably connected to the anchor bushing, a shackle pivotally mounted on the hanger ring, and means to releasably connect the hanger ring to the anchor bushing including a retractable member carried by the hanger ring and insertable into the anchor bushing, said ring including a pin having a manual operator projecting outwardly from the hanger ring, said manual operator being rotatable from a first position locking the pin in the anchor bushing to a second position permitting the pin to be withdrawn from the anchor bushing enabling the hanger ring to be removed from the anchor bushing.

13. A hoist ring assembly, comprising: an anchor bushing connectable to a load, a hanger ring releasably connected to the hoist ring assembly, a shackle pivotally mounted on the hanger ring, and means to releasably connect the hanger ring to the anchor bushing including retractable pin means carried by the hanger ring and insertable into the anchor bushing, said anchor bushing including a cylindrical outer surface, said hanger ring having a cylindrical inner surface that engages and is slidable axially on the anchor bushing cylindrical outer surface, said anchor bushing cylindrical outer surface having at least one aperture therein for releasably receiving the pin means carried by the hanger ring, said pin means including a pin having a manual operator projecting outwardly from the hanger ring, said manual operator being rotatable from a first position locking the pin in the anchor bushing to a second position permitting the pin to be withdrawn from the anchor bushing enabling the hanger ring to be removed from the anchor bushing, said pin means pin having an axial slot that connects with an annular groove in the pin, a radial member in the hanger ring projecting into the annular groove in the first position of the operator to block movement of the pin from the anchor bushing and movable into the axial slot in the second position of the operator to permit withdrawal of the pin from the anchor bushing, said slot also limiting outward movement of the pin from the hanger ring, said anchor bushing including a rotatable outer sleeve so the hanger ring can swivel on the anchor bushing.

* * * * *